US008888231B2

(12) United States Patent
Aoyama et al.

(10) Patent No.: US 8,888,231 B2
(45) Date of Patent: Nov. 18, 2014

(54) CLEANING METHOD AND CLEANING DEVICE

(71) Applicant: Seiko Epson Corporation, Tokyo (JP)

(72) Inventors: Tetsuya Aoyama, Shiojiri (JP); Hitoshi Ohta, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/850,786

(22) Filed: Mar. 26, 2013

(65) Prior Publication Data

US 2013/0257975 A1 Oct. 3, 2013

(30) Foreign Application Priority Data

Apr. 2, 2012 (JP) ..... 2012-083625

(51) Int. Cl.

| | |
|---|---|
| ***B41J 2/165*** | (2006.01) |
| ***B41J 2/175*** | (2006.01) |
| ***B41J 2/19*** | (2006.01) |
| ***B41J 2/17*** | (2006.01) |

(52) U.S. Cl.

CPC ..... *B41J 2/1714* (2013.01); *B41J 2/1707* (2013.01); *B41J 2/16526* (2013.01); *B41J 2/16552* (2013.01)

USPC ..... 347/28; 347/35; 347/92

(58) Field of Classification Search

USPC ..... 347/28, 35, 92

See application file for complete search history.

(56) References Cited

U.S. PATENT DOCUMENTS

| | | | | |
|---|---|---|---|---|
| 5,825,380 | A * | 10/1998 | Ichizawa et al. | 347/28 |
| 5,923,347 | A * | 7/1999 | Wade | 347/28 |
| 6,196,657 | B1 * | 3/2001 | Hawkins et al. | 347/28 |
| 8,297,732 | B2 | 10/2012 | Niimi et al. | |
| 2005/0018023 | A1 * | 1/2005 | Momose et al. | 347/95 |
| 2007/0109368 | A1 * | 5/2007 | Kimura | 347/86 |
| 2010/0245461 | A1 * | 9/2010 | Niimi et al. | 347/28 |

FOREIGN PATENT DOCUMENTS

| | | |
|---|---|---|
| JP | 2003-211702 | 7/2003 |
| JP | 2010-228297 | 10/2010 |

OTHER PUBLICATIONS

Manufacturer's product data for Surfynol 420.*

* cited by examiner

*Primary Examiner* — Stephen Meier
*Assistant Examiner* — Alexander D Shenderov
(74) *Attorney, Agent, or Firm* — Harness, Dickey & Pierce, P.L.C.

(57) ABSTRACT

A cleaning method of an ink supply path in a recording apparatus where ink is supplied from an ink cartridge, includes a first cleaning step of cleaning by supplying to the ink supply path a gas-liquid mixture of a cleaning liquid A provided with an ink cleaning action and gas, and a second cleaning step of cleaning by supplying to the ink supply path a cleaning liquid B provided with an air bubble suppressing action after the first cleaning step.

12 Claims, 5 Drawing Sheets

100

CLEANING METHOD AND CLEANING DEVICE

Priority is claimed under 35 U.S.C. §119 to Japanese Application No. 2012-083625 filed on Apr. 2, 2012, which is hereby incorporated by reference in its entirety.

BACKGROUND

1. Technical Field

The present invention relates to a cleaning method and a cleaning device appropriate for an ink jet recording apparatus.

2. Related Art

An ink jet recording apparatus is provided with a cartridge holder and a recording head, and is configured to discharge ink droplets from the recording head corresponding to print data for forming an image on a recording medium such as paper by supplying ink to the recording head through an ink supply path from an ink cartridge which is attached to a cartridge.

In such an ink jet recording apparatus, since a printing test has been performed prior to a product shipment, ink remains in the ink supply path. When ink has been left undone in the ink supply path for a long time, a problem may occur such that a clogging of ink is formed in the recording head.

In order to eliminate ink from the ink supply path, at the time when the printing test has been finished prior to the product shipment, an operation to clean the ink supply path from the cartridge holder to the recording medium is first performed, and then the shipment of the product is made. Cleaning the ink supply path is performed in a manner that a cleaning liquid is introduced to the ink supply path by attaching a cleaning liquid cartridge containing the cleaning liquid to the cartridge holder, or connecting a tube where the cleaning liquid is supplied to the cartridge holder.

Recently, in the large ink jet recording apparatus, since an ink supply path from a cartridge holder to a recording head becomes comparatively greater in length than before, it is necessary to enhance a cleaning efficiency. As a method to enhance the cleaning efficiency, a cleaning method to strengthen a cleaning action has been suggested by mixing air into the cleaning liquid introduced to the ink supply path. For example, JP-A-2003-211702 (see paragraph [0009]) discloses a mixture generating unit which is capable of continuously generating a mixture in which air is mixed with a cleaning liquid, and a cleaning method that introduces the mixture in which air is mixed with the cleaning liquid generated from the mixture generating unit to the ink supply path of a recording apparatus. In addition, JP-A-2010-228297 (see paragraph [0008]) discloses a cleaning unit with a gas-liquid two-phase agent generating unit which generates a gas-liquid two-phase agent by mixing a cleaning liquid and gas, and a gas-liquid two-phase agent supplying unit which is connected to an upstream end in the direction where ink flows in the ink supply tube and supplies the gas-liquid two-phase agent generated by the gas-liquid two-phase agent generating unit to an ink supply tube.

In the cleaning methods as disclosed in JPA-2003-211702 and JP-A-2010-228297, the cleaning liquid in which gas is mixed (hereinafter, it will be referred to as "gas-liquid mixture") remains in the ink supply path after cleaning. If the recording apparatus is shipped in such a state, when a user installs an ink cartridge and refills ink, an air bubble contained in the cleaning liquid is likely to have been mixed into ink. Printing with ink where an air bubble is mixed causes a pressure loss to occur at the time of discharging the ink.

Therefore, a bad quality is likely to be caused such as ink dot omissions due to curved flight of ink droplets or failure of discharging ink droplets.

SUMMARY

An advantage of some aspects of the invention is to provide a cleaning method and an ink jet recording apparatus which are capable of securing a high discharge stability of refilled ink even immediately after cleaning an ink supply path.

Inventors of the present application have closely reviewed the aforementioned problem. The inventors have thought of utilizing a point that there is a function to suppress an air bubble in a specified cleaning liquid, and have eventually invented a cleaning method which is capable of eliminating an air bubble from a gas-liquid mixture remaining in an ink supply path, and therewith, a configuration of a cleaning device.

(1) According to an aspect of the invention, there is provided a cleaning method of an ink supply path in a recording apparatus in which ink is supplied from an ink cartridge, the method includes first cleaning the ink supply path by supplying a gas-liquid mixture of a cleaning liquid A provided with an ink cleaning action and gas to the ink supply path, and second cleaning the ink supply path by supplying a cleaning liquid B provided with an air bubble suppressing action after the first cleaning step to the ink supply path.

In addition, according to another aspect of the invention, there is provided a cleaning device of an ink supply path for a recording apparatus in which ink is supplied from an ink cartridge, the cleaning device includes a gas-liquid mixture generating unit which generates a gas-liquid mixture by mixing a cleaning liquid A which is provided with an ink cleaning action and gas, and a selective unit which selects one of the gas-liquid mixture and a cleaning liquid B provided with an air bubble suppressing action, and introduces the selected cleaning liquid to the ink supply path, wherein the selective unit is configured to introduce the cleaning liquid B to the ink supply path after having cleaned the ink supply path by supplying the gas-liquid mixture to the ink supply path.

In these cases, after an effective cleaning of an ink supply path with a gas-liquid mixture of a cleaning liquid and gas, a cleaning liquid B provided with an air bubble suppressing action is supplied to the ink supply path. Therefore, it is possible to efficiently eliminate an air bubble from the gas-liquid mixture remaining in the ink supply path. Thus, at the time of refilling ink thereafter, it is possible to prevent an occurrence of discharge failure due to the remaining air bubble, and to secure a high discharge stability.

If desired, aspects of the invention may include the following characteristics.

(2) In the cleaning method according to (1), the cleaning liquid B may include a surfactant of HLB value 6 or less as an air bubble suppressing agent.

(3) In the cleaning method according to (1) or (2), the cleaning liquid B may be controlled to have a dissolved nitrogen content of 10 ppm or less.

(4) In the cleaning method according to any one of (1) to (3), the cleaning liquid B may be used as the cleaning liquid A.

(5) In the cleaning method according to any one of (1) to (4), the cleaning liquid B may be controlled to have a viscosity of 2 mPa·s to 8 mPa·s at 20° C.

(6) In the cleaning method according to any one of (1) to (5), the cleaning liquid B may be introduced at a flow velocity of 0.1 mL/(sec·mm$^2$) or more.

(7) In the cleaning method according to any one of (1) to (6), the gas-liquid mixture may be introduced by a connecting unit configured to be possibly introduced to the ink supply path in the first cleaning step.

(8) According to still another aspect of the invention, there is provided a cleaning liquid which is the cleaning liquid B in the cleaning method according to any one of (1) to (7).

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings, wherein the same or like numbers reference the same or like elements respectively. However, the drawings are schematic and the specific dimensions have to be determined with cross-reference to the description below. In addition, it goes without saying that different parts in dimensional relation or ratio mutually among the drawings are included.

In addition, the embodiments shown below are merely illustrations, and accordingly, it should be understood that they do not limit the technological scope claimed by the invention. With regard to the other embodiments which solve the problems of the invention, and exhibit the effects of the invention, it is possible to variously modify the invention and apply them.

DEFINITION

Terms used in the present specification are defined as follows:

"Gas-liquid mixture" is referred to as a cleaning liquid where gas is mixed actively in the form of air bubble, the mixing method of the cleaning liquid and the gas is not limited, and no limitation is imposed to a composition of the cleaning liquid or gas, "Air bubble suppressing action" is referred to as an action to reduce air bubbles mixed in liquid. The action is desirable when it reduces the content of air bubble, and there is no need to completely eliminate air bubbles, "HLB value" is an abbreviation of "Hydrophile-Lipophile Balance", means hydrophilic-lipophilic balance which represents the degree of affinity of a surfactant to an organic compound insoluble in water, and "Antifoaming agent" includes a composition provided with an air bubble suppressing action, and a surfactant of HLB value 6 or less is a typical example of the agent.

Embodiment 1

Embodiment 1 of the invention is relating to an example of a gas-liquid mixture generating device using a float member.

1. Configuration of Recording Apparatus

A configuration of an ink jet recording apparatus as shown below is formed to be capable of being connected to a cleaning device shown in each of embodiments described hereafter, and such that a cleaning method of the invention is applied. However, the cleaning method and device of the invention is not limited to the configuration of the ink jet recording apparatus shown below, and is applicable to the overall recording apparatuses configured to possibly supply ink through an ink supply path from an ink cartridge.

Figure 1:
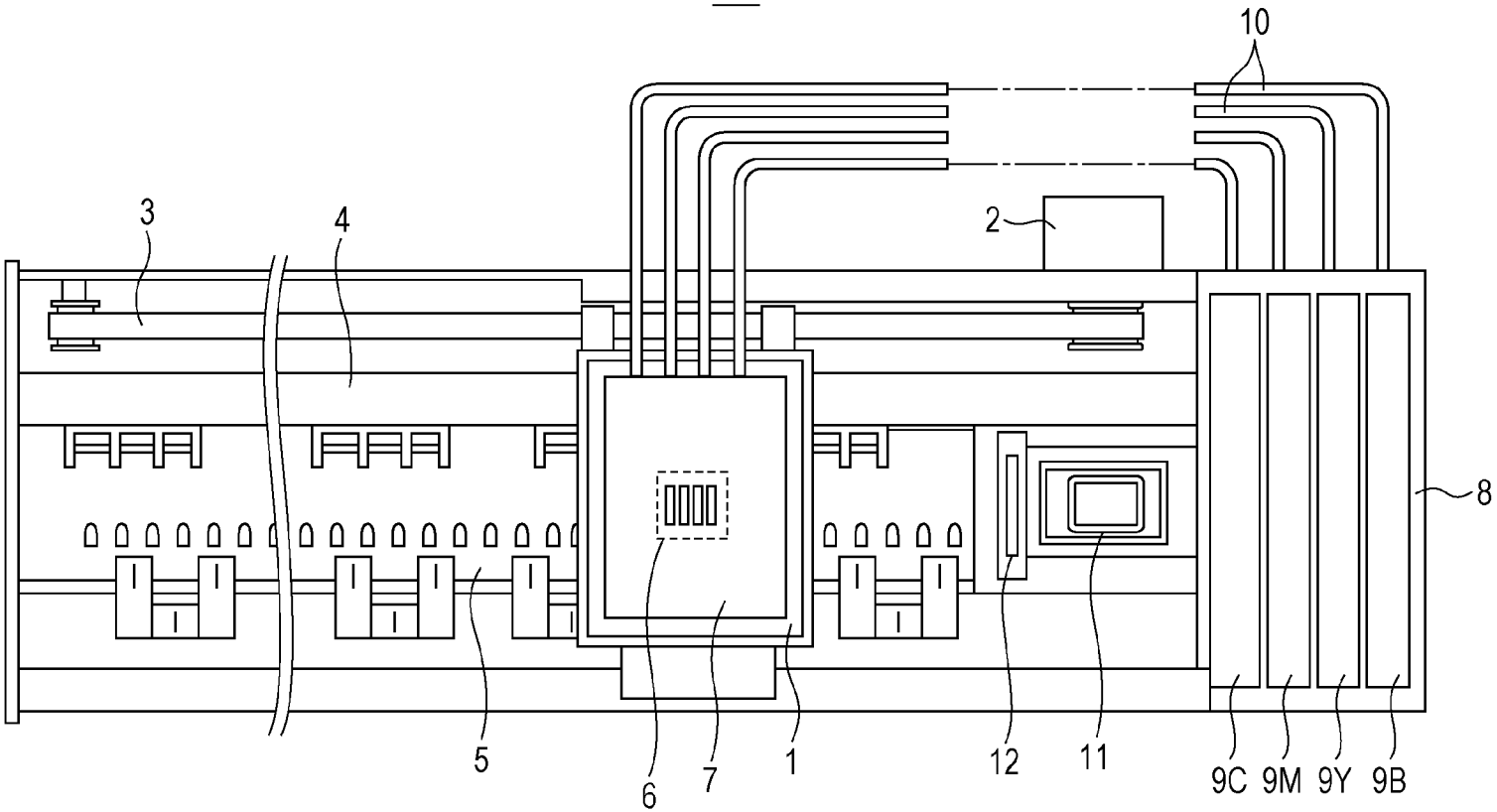
FIG. 1 is a schematic view of a recording apparatus to be possibly used in various embodiments of the invention.

FIG. 1 is a plan view illustrating a schematic configuration of the ink jet recording apparatus according to the embodiment. As shown in FIG. 1, an ink jet recording apparatus 100 of the embodiment is provided with a carriage 1, a carriage motor 2, a timing belt 3, a guide member 4, a paper transporting member 5, a cartridge holder 8, a capping member 11, and a wiping member 12.

The carriage 1 is configured to be connected and held to be possibly driven by the timing belt 3 driven by the carriage motor 2, and to be driven back and forth along the longitudinal direction of the paper transporting member 5 while being guided by the guide member 4. The carriage 1 is provided with a recording head 6 whose ink discharging surface faces the paper transporting member 5, and is also provided with a damper 7 which temporarily stores ink supplied to the recording head 6 on a surface of the opposite side (front side of the drawing) to the ink discharging surface.

The cartridge holder 8 is configured so that multiple color ink cartridges are attached thereto. For example, as shown in FIG. 1, color ink cartridges 9B, 9C, 9M, and 9Y which supply each of inks such as black, cyan, magenta, and yellow respectively are detachably attached.

An ink supply path 10 is formed of flexible material, is a conduit line connecting between the cartridge holder 8 and the damper 7, and is configured to supply ink to the damper 7 from each of the ink cartridges 9. The ink supply path 10 is a member which becomes a main object of cleaning by the cleaning method of the invention.

The capping member 11 is disposed at the range where the carriage 1 is capable to scan, is formed at a non-printing area where a printing is not performed, and is configured to rise and seal a nozzle-formed surface of the recording head 6 at the time when the carriage 1 moves to the non-printing area. The capping member 11 functions as a lid which seals the nozzle-formed surface of the recording head 6 during an idle state of a recording apparatus, and works to prevent an ink solvent from being volatilized from a nozzle opening of the recording head 6.

Figure 2:
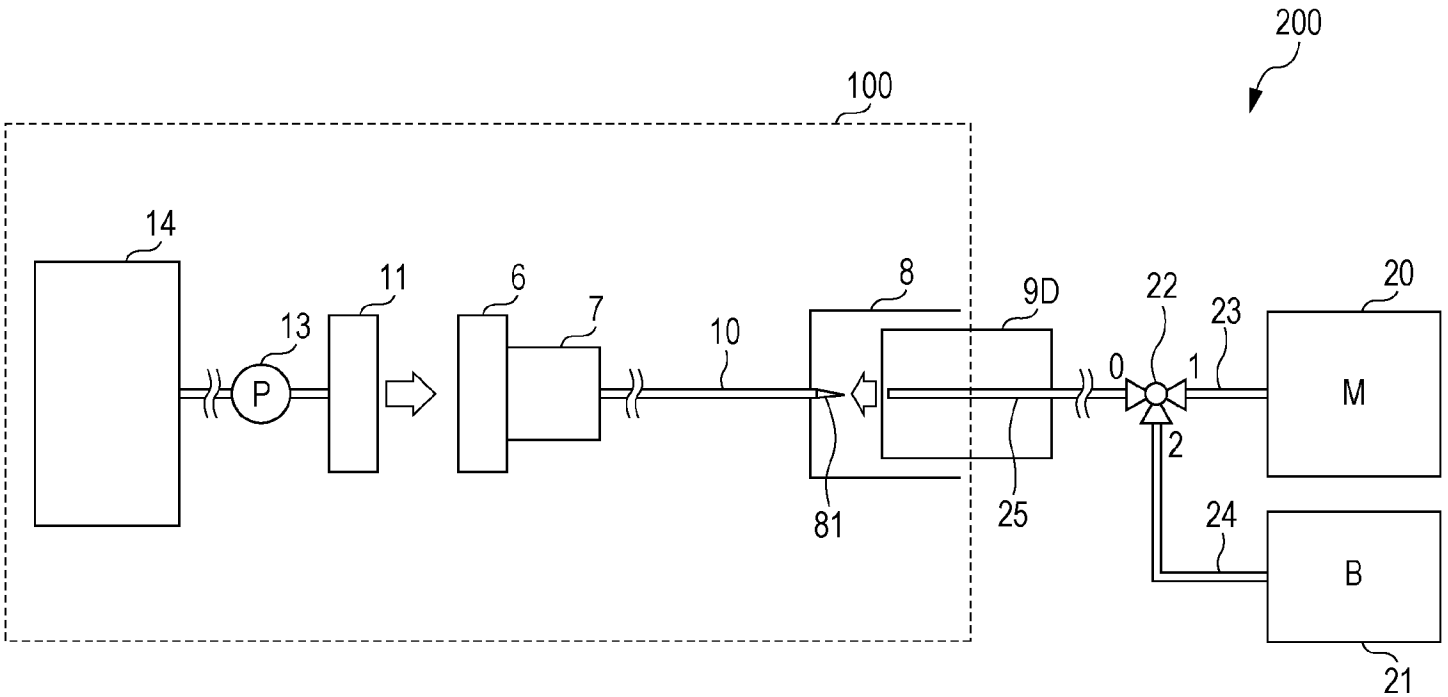
FIG. 2 is a connection configuration diagram of a recording apparatus and a cleaning device in a first embodiment of the invention.

The capping member 11 is connected to a suction pump 13 shown in FIG. 2, and is configured so as to absorb ink stored in a nozzle, the damper 7, and the ink supply path 10 by exerting a negative pressure on the nozzle-formed surface of the recording head 6 when the negative pressure from the suction pump 13 has been applied. Such a suction of ink is to perform a cleaning method of the invention as well as a cleaning function to recover a clogging of the nozzle of the recording head 6.

Moreover, the suction pump 13 is driven in a state of being connected to a cleaning device 200 described hereafter.

Therefore, it is preferable that the suction pump 13 has a driving capability to be capable to circulate a cleaning liquid A and a cleaning liquid B with a flow velocity of 0.1 mL/(sec·mm$^2$) or more. Thus, in the case of the flow velocity of 0.1 mL/(sec·mm$^2$) or more, it is possible to enhance a cleaning capability of the ink supply path 10 and an inner wall of the recording head 6.

The wiping member 12 is disposed at a printing area adjacent to a capping unit 11, and is a member in which an elastic material such as rubber is molded into a strip shape. The wiping member 12 is configured to perform a wiping operation of wiping and cleaning the nozzle-formed surface of the recording head 6 by entering in the horizontal direction toward a moving path of the recording head 6 when the carriage 1 moves back and forth to the capping member 11.

2. Configuration of Cleaning Device

FIG. 2 is a connection configuration diagram of an ink jet recording apparatus and a cleaning device in the embodiment. As shown in FIG. 2, the ink jet recording apparatus 100 according to the embodiment is configured to be connected to the cleaning device 200 by attaching a dummy cartridge 9D to the cartridge holder 8. FIG. 2 is a schematic diagram schematically illustrating configuration components which relate to the invention. FIG. 2 exemplifies a set of the cartridge holder 8 regarding one kind of ink, the ink supply path 10, the damper 7, and the recording head 6.

As described before, in the ink jet printing apparatus 100, the cartridge holder 8 is connected to the damper 7 and the recording head 6 through the ink supply path 10. The capping member 11 is connected to a waste liquid recovering box 14 through the suction pump 13. The capping member 11 is configured to be capable to move (shown by an arrow) so as to seal the nozzle-formed surface of the recording head 6.

On the other hand, the cleaning device 200 is configured to have a gas-liquid mixture generating unit 20, a cleaning liquid tank 21, a selective valve 22, and the dummy cartridge 9D.

The cleaning liquid tank 21 is a container storing the cleaning liquid B according to the invention, is configured to be capable to supply the cleaning liquid B, and is not limited to the shape and the material. The cleaning liquid tank 21 is connected to a selective opening (which is referred to as "side 2") of the other side of the selective valve through a supply path 24.

The selective valve 22 is a selective unit according to the invention, and is configured to select any one of a supply path 23 which is connected to a side 1 or the supply path 24 which is connected to the side 2, and connect the selected supply path to a supply path 25 which is connected to a side 0. The selective valve 22 may be configured to be switched manually by an operator, but also may be configured to be controlled and to be switched by a controller. Such a controller is functionally realized by causing a computer to execute a software program for executing a selection method according to the invention.

The dummy cartridge 9D has the same appearance dimensions as an ink cartridge 9. A relay supply path 25 is provided inside of the dummy cartridge 9D. One end of the relay supply path 25 is connected to a common opening (which is referred to as "side 0") which is an outlet of the selective valve 22, and the other end of the relay supply path 25 passes through the inside of the dummy cartridge 9D, and forms an aperture disposed so as to face a connecting opening of an ink supply opening 10 when attached to the cartridge holder 8.

The gas-liquid mixture generating device 20 is a gas-liquid mixture generating unit according to the invention, is configured to generate and supply a gas-liquid mixture M in which gas is mixed into a cleaning liquid A, and will be specifically described in an embodiment described later. The gas-liquid mixture M generated by a gas-liquid mixture generating device 2 is connected to the selective opening of one hand of the selective valve 22 (which is referred to as "side 1") through the supply path 23.

Moreover, the embodiment uses the dummy cartridge 9D as a connecting adapter, and exemplifies an aspect which supplies the cleaning liquid to the ink jet recording apparatus 100 from the cleaning device 200 provided outside. However, it is possible to be configured so that the gas-liquid mixture generating device 20, the cleaning tank 21, and part or all of the selective valve 22 are provided inside a package of the dummy cartridge 9D.

In addition, as for the embodiment, for making a simple description, it is assumed that there is provided one dummy cartridge 9D where the cleaning liquid is supplied from the selective valve 22, but it is desirable that there are provided dummy cartridges 9D as many as the number of attachable ink cartridges 9, and that they are configured so that the cleaning liquid is capable to be supplied in common from the selective valve 22. When configured in this manner, it is possible to simultaneously clean all the plurality of the ink supply path 10.

Figure 3:
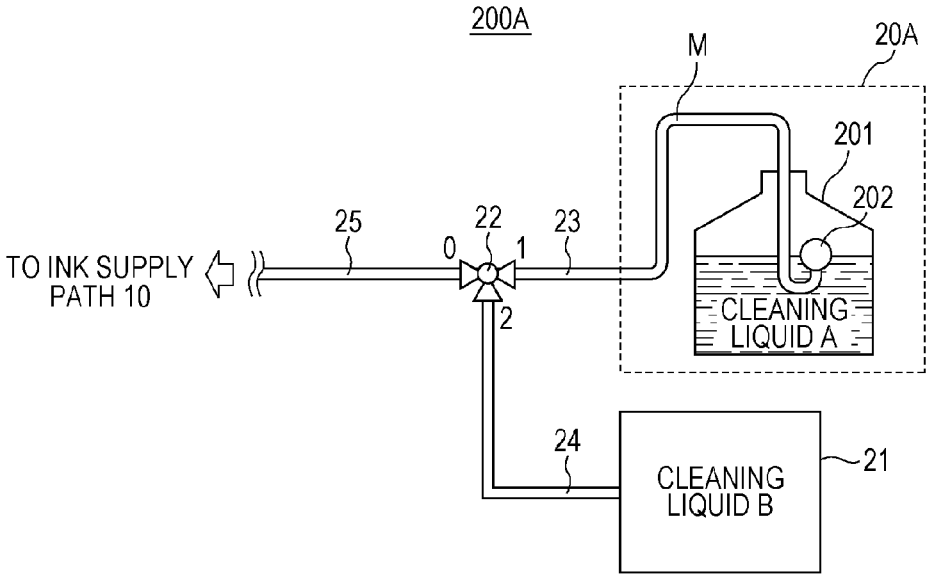
FIG. 3 is a configuration diagram of a cleaning device in the first embodiment of the invention.

FIG. 3 is a configuration diagram specifically illustrating a cleaning device in embodiment 1. As shown in FIG. 3, a gas-liquid mixture generating device 20A of a cleaning device 200A according to embodiment 1 is provided with a gas-liquid mixture generating unit 201. The gas-liquid mixture generating unit 201 is charged with the cleaning liquid A inside. In the liquid surface of the cleaning liquid A, a float member 202 is provided so as to float. A buoyancy of the float member 202 is adjusted so that the upper half is exposed from the liquid surface of the cleaning liquid, and the lower half is submerged in the cleaning liquid. The supply path 23 is introduced from the top portion of a gas-liquid mixture generating unit 201, and is connected to a float member 202 from the bottom side. A flow path is formed inside of the float member 202, which is caused to communicates with the supply path 23 not shown in the figure, and a suction opening of the flow path is opened at the position which becomes a boundary between a cleaning liquid surface and air at a state of the float member 202 floating in the cleaning liquid A.

3. Cleaning Liquid

Next, a description will be given with regard to a composition of a cleaning liquid according to the embodiment. A common composition between the cleaning liquid A and the cleaning liquid B, and then, a characteristic composition and a characteristic will be described in the case of the cleaning liquid B.

The cleaning liquid A and the cleaning liquid B according to the embodiment are provided with a penetrating agent, a viscosity modifier in common.

Penetrating Agent

The penetrating agent of the embodiment includes the penetrating agent such as a surfactant and a water-soluble penetration solvent. The penetrating agent is provided with an action that spreads the cleaning liquid evenly on the inner wall of the ink supply path.

Surfactant

As for the surfactant, no particular limitation is imposed, but a nonionic surfactant may be used. Among the nonionic surfactants, only the following ones don't have to be used, but acetylenic glycol-based, silicone-based, polyoxyethylene alkyl ether-based, polyoxypropylene alkylether-based, polycyclic phenyl ether-based, sorbitan derivative, and fluorochemical surfactants can be considered. And among the above mentioned, at least any one of the surfactants may be preferably used such as acetylenic glycol-based surfactant, silicone-based surfactant, fluorochemical surfactant.

The acetylenic glycol-based surfactant has a superior ability to maintain proper tension and interfacial tension compared to other nonionic surfactants, and further, has a characteristic that there is almost no foamability. Especially, since the acetylenic glycol-based surfactant shows a good affinity (wettability) to the ink supply path, it is suitable for the cleaning liquid.

As for the acetylenic glycol-based surfactant, for example, the followings are exemplified. Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, DF-110D, 82 (all trade names, manufactured by Air Products and Chemicals. Inc.), Olfine B, Y, P, A, STG, SPC, E1004, E1010, PD-001, PD-002W, PD-003, PD-004, EXP. 4001, EXP. 4036, EXP. 4051, EXP. 4300, AF-103, AF-104, AK-02, SK-14, AE-3 (all trade names, manufactured by Nissin Chemical Industry Co., Ltd.), acetylenol E00, E00P, E40, E100 (all trade names, manufactured by Kawaken Fine Chemicals Co., Ltd.) and the like.

The silicone-based surfactant has a superior characteristic in the action of spreading the cleaning liquid evenly as with other nonionic-based surfactants. As for the silicone-based surfactant, no particular limitation is imposed, but polysiloxane-based compound may be exemplified. As for the polysiloxane-based compound, no particular limitation is imposed, but, for example, polyether denaturation organosiloxane is exemplified.

Such as polysiloxane-based compound is preferably used as the silicone-based surfactant, and such as polyether denaturation organosiloxane and the like are exemplified. More particularly, the followings are exemplified. BYK-306, BYK-307, BYK-333, BYK-341, BYK-345, BYK-346, BYK-347, BYK-348, BYK-349 (all trade names, manufactured by BYK Japan KK.), KF-351A, KF-352A, KF-353, KF-354L, KF-355A, KF-615A, KF-945, KF-640, KF-642, KF-643, KF-6020, X-22-4515, KF-6011, KF-6012, KF-6015, KF-6017 (all trade names, manufactured by Shin-Etsu chemical Co., Ltd.) and the like.

The fluorochemical surfactant has a superior characteristic in the action of spreading the cleaning liquid evenly as with other nonionic-based surfactants. As the fluorochemical surfactant, what was synthesized appropriately may be used, and a commercially available product may be used. As the commercially available product, for example, the followings are exemplified. S-144, S-145 (manufactured by Asahi Glass Co., Ltd.); FC-170C, FC-430, Fluorad-FC4430 (manufactured by Sumitomo 3M Ltd.); FS0, FS0-100, FSN, FSN-100, FS-300 (manufactured by Dupont Co.); FT-250, 251 (Manufactured by Neos Co., Ltd.) and the like. Among these, it is preferable that FSO, FSO-100, FSN, FSN-100, FS-300 manufactured by Dupont are capable to provide a good printing quality and storability. The surfactants which are nonionic-based fluorochemical surfactant may be used alone, or in combination of two or more.

The surfactants may be used alone or as a mixture of two or more kinds. It is preferable that the content of these surfactants is in the range from 0.1 mass % to 3 mass %, with regard to the total weight of the cleaning liquid (100 mass %) since exhibiting a suitable cleaning action.

Water-Soluble Penetration Solvent

As the water-soluble penetration solvent, a monohydric alcohol, or a polyalcohol, and a derivative are exemplified.

As a monohydric alcohol, it is possible that, particularly, the monohydric alcohol having a carbon number 1 to 4, for example, may be used such as methanol, ethanol, n-propanol, i-propanol, or n-butanol.

As the polyalcohol and the derivative thereof, it is possible that dihydric to pentavalent alcohols having carbon numbers 2 to 6, and a full or partial ether of a lower alcohol having carbon numbers 1 to 4 therewith are used. Here, a polyalcohol derivative is an alcohol derivative in which at least one hydroxyl group is an etherified alcohol derivative, and is not referred to as the polyalcohol in itself which doesn't contain an etherified hydroxyl group.

As concrete examples of the polyalcohol and a lower alkylether, the followings are exemplified such as diols such as 1,2-hexanediol, 1,3-hexanediol, 1,2-heptanediol, 1,3-heptanediol, 1,2-octanediol, 1,3-octanediol, 1,2-pentanediol, and mono, di, or triethylene glycol mono, or dialkyl ether, mono, di, or tripropylene glycol mono, or dialkyl ether, and the followings may be exemplified such as 1,2-hexanediol, triethylene glycol monobutyl ether, diethylene glycol monobutyl ether, diethylene glycol monopropyl ether, diethylene glycol monopentyl ether, or propylene glycol monobutyl ether.

It is preferable that the content of the penetrating agent be in the range from 0.05 mass % to 15 mass % with regard to the total weight of the cleaning liquid (100 mass %) since enhancing a wettability with regard to a recording medium. When the content is 0.05 mass % or more, the wettability of the cleaning liquid is enhanced. In addition, when the content is 15 mass % or less, the cleaning liquid becomes a low viscosity, and it is possible to enhance an effect of eliminating the clogging of the ink supply path or recording head, and further, a storage stability is improved.

Viscosity Modifier

It is preferable that the cleaning liquid A and the cleaning liquid B of the embodiment contain the viscosity modifier. As the viscosity modifier, the followings are exemplified. The polyalcohol such as glycerine, ethyl alcohol, 2-propanol, ethylene glycol, diethylene glycol, propylene glycol, dipropylene glycol, 1,3-propanediol, 1,3-butanediol, 1,4-butanediol, 2-methyl-1,3-butane, 3-methyl-1,5-pentanediol, hexylene glycol, 2,3-butanediol, or saccharides and sugar alcohol and the like. With regard to the total weight of the cleaning liquid, it is preferable that the content of the viscosity modifier be in the range from 1 mass % to 50 mass %, and more preferable that the content thereof be in the range from 5 mass % to 40 mass %.

Characteristic of Cleaning Liquid B

Since the cleaning liquid B of the embodiment contains the surfactant as the antifoaming agent, it is preferable to be adjusted so as to exhibit the air bubble suppressing action.

HLB Value

As the cleaning liquid B of the embodiment, it is preferable to contain the surfactant of an HLB value 6 or less as the antifoaming agent.

As the antifoaming agent having a good defoaming property, for example, a silicone antifoaming agent, a polyether antifoaming agent, a fatty acid ester antifoaming agent, an acetylenic-based antifoaming agent and the like are suitably exemplified. It may be used alone or in combination of two kinds or more. Among them, it is preferable that the silicone antifoaming agent and the acetylenic-based antifoaming agent be used in terms of superior foam breaking effect.

It is preferable that the surfactant having the defoaming property is in the range of the HLB value 6 or less based on Griffin's law, and more preferable that it is in the range of the value 5 or less. Since the surfactant of the HLB value 6 or less has a high lipophilicity, and suppresses a generation of bubbles in an ink flow path at the time of cleaning, it is possible to reduce a bad discharge of a recording ink composition due to a mixing of bubbles. Especially, when using a piezo type ink jet recording apparatus, since the bad discharge is likely to occur due to the generation of bubbles in the ink flow path, it is preferable to use the surfactant of the HLB value 6 or less.

Here, the HLB value of the surfactant used in the embodiment is a value to evaluate a hydrophilicity of compounds proposed by Griffin, and is a value calculated according to the following formula (I). The HLB value according to Griffin law shows a value in the range of 0 to 20, and indicates that the larger a value is, the more hydrophilic a compound is.

$$\text{HLB value}=20\times(\text{mass \% of hydrophilic group})=20\times(\text{sum of formula weight of hydrophilic group}/\text{molecular weight of surfactant}) \quad (1)$$

As the surfactant of the HLB value 6 or less, particularly, the followings are exemplified. Surfynol 104, 104E, 104H, 104A, 104BC, 104DPM, 104PA, 104PG-50, 104S, 420, DF-110D, 82 (all trade names, manufactured by Air Products and Chemicals, Inc.), BYK-011, BYK-012, BYK-017, BYK-018, BYK-019, BYK-020, BYK-021, BYK-022, BYK-023, BYK-024, BYK-025, BYK-028, BYK-038, BYK-044, BYK-080A, BYK-093, BYK-094, BYK-1610, BYK-1615, BYK-1650, BYK-1660, BYK-1730, and BYK-1770 (all trade names, manufactured by BYK Japan KK.).

It is preferable that the addition amount of the surfactants is in the range of 0.01 mass % to 3 mass % with regard to the total quantity of the cleaning liquid B, from a viewpoint of the air bubble suppressing action, and more preferable that the addition amount is in the range of 0.1 mass % to 2 mass %. In the case of 0.01 mass % or more, the air bubble suppressing action of the cleaning liquid B may be realized, and, in the case of 3 mass % or less, it is possible to stably dissolve it in the cleaning liquid B, and to secure the storage stability.

Dissolved Gas Content

In addition, as for the cleaning liquid B of the embodiment, it is preferable that a dissolved content of a nitrogen is adjusted to 10 ppm or less. When the dissolved content of the nitrogen is 10 ppm or less, since the quantity of gas dissolved in the cleaning liquid B in itself is small, it is possible to suppress a possibility of generating new bubbles to a significantly low level even though the cleaning liquid B is supplied at a high flow velocity. In addition, the air bubble suppressing action of the ink supply path may be effectively realized by dissolving air bubbles which remain in the ink supply path with the cleaning liquid B.

Viscosity

Further, it is preferable that the cleaning liquid B of the embodiment be adjusted so as to be the viscosity 2 mPa·s to 8 mPa·s at 20° C. The reason is that, when the viscosity is in such a range, it is possible to perform the air bubble suppressing action suitably. When the viscosity exceeds such range, the viscosity rises, and in the case where the cleaning liquid B remains in the ink supply path, the recording head, and the other circulation path, as a result, the clogging becomes to occur. In addition, if the viscosity is decreased below such range, a fluidity is increased exceedingly. As a result, the air bubble suppressing action is not only decreased, but also air bubbles are likely to be newly generated. The cleaning liquid B is adjusted so that the viscosity may be obtained by applying to add the viscosity modifier.

Moreover, there is a case that the cleaning liquid which satisfies the requirement about the HLB value, the dissolved gas content, and the viscosity has a cleaning function of the ink supply path. Therefore, as shown in embodiments 2 to 4, which will be described later, it is possible that the cleaning liquid B is used as the cleaning liquid A.

Other Additive

The cleaning liquid A and the cleaning liquid B of the embodiment is capable to further contain water as a balance as well as the additive.

As for water, it is preferable that pure water such as an ion-exchange water, an ultrafiltration water, a reverse-osmosis water, and a distilled water, or a hyperpure water be used. Particularly, it is preferable that the water be sterilized by means of an ultraviolet irradiation, or an addition of a hydrogen peroxide and the like since a generation of mold or bacteria can be prevented in the sterilized water for a long period of time.

Further, if necessary, the cleaning liquid A and the cleaning liquid B in this embodiment may be caused to contain one kind or more of various additives which can be usually used in an ink composition for an ink jet such as a dissolution assistant, a ph modifier, a preservative, a fungicide, a rust-preventive agent, a chelating agent, an antioxidant, an ultraviolet absorbing agent, and an oxygen absorbing agent.

The dissolution assistant is selected from water soluble solvents compatible with the antifoaming agent added to the cleaning liquid B. The most suitable combination depending on the antifoaming agent used is present, but the followings are preferable, for example, heterocyclic compound water-soluble, alkylene glycol alkyl ether water-soluble, pyrrolidones such as N-methyl-2-pyrrolidone, N-ethyl-2-pyrrolidone, N-vinyl-2-pyrrolidone and 2-pyrrolidone, lactones such as 7-butyrolactone, sulfoxides such as dimethyl sulfoxide, lactams such as ϵ-caprolactam, esters such as methyl lactate, ethyl lactate, isopropyl lactate, and butyl lactate, oxyalkylene glycol ethers such as ethylene glycol monomethyl ether, ethylene glycol dimethyl ether, ethylene glycol monomethyl ether acetate, diethylene glycol monomethyl ether, diethylene glycol dimethyl ether, diethylene glycol ethyl methyl ether, diethylene glycol diethyl ether, diethylene glycol isopropyl ether, diethylene glycol-2-ethyl hexyl ether, propylene glycol monomethyl ether, propylene glycol dimethyl ether, dipropylene glycol monomethyl ether, dipropylene glycol dimethyl ether, and dipropylene glycol monopropyl ether, and cyclic ethers such as 1,4-dioxane. Particularly, pyrrolidones, and alkylene glycol monoalkyl ethers such as propylene glycol monomethyl ether, dipropylene glycol monomethyl ether, dipropylene glycol monopropyl ether are preferable in a viewpoint of the storage stability of the cleaning liquid B.

As the pH modifier, for example, potassium dihydrogen-phosphate, disodium hydrogen-phosphate, sodium hydroxide, lithium hydroxide, potassium hydroxide, ammonia, diethanolamine, triethanolamine, triisopropanolamine, potassium carbonate, sodium carbonate, sodium hydrogen carbonate and the like are exemplified.

As the preservative and the fungicide, for example, sodium benzoate, sodium pentachlorophenol, 2-pyridinethiol-1-oxide sodium, sodium sorbate, sodium dehydroacetate, 1,2-dibenzisothiazolin-3-on and the like are exemplified. As commercially available products, proxel XL2, proxel GXL (all trade names, manufactured by Avecia), or Denisaido CSA, NS-500W (all trade names, manufactured by Nagase ChemteX Corporation) and the like are exemplified.

As the rust-preventive agent, for example, benzotriazole and the like are exemplified.

As the chelating agent, for example, ethylenediamine tetraacetic acid and salts thereof (Salt of ethylenediaminetetraacetic acid disodium dihydrogen, and the like), iminodisuccinic acid and salts thereof are exemplified.

Furthermore, it is desirable that the cleaning liquid B in the embodiment contains a color material in it. By coloring the cleaning liquid B, the cleaning liquid B is capable to be used as an inspection ink used for inspecting a normal discharge of a head prior to shipment. As a result, at the time of the shipment, a complicated step is capable to be omitted such as replacing the ink flow path with the cleaning liquid B once again.

As the color material, for example, a pigment, a dye, or the like are exemplified.

Particularly, as for a pigment, a known inorganic pigment, an organic pigment, and carbon black may be used, and, for example, the followings may be used. Azo pigment such as azo pigment insoluble, condensed azo pigment, azo lake, and chelate azo pigment, polycyclic pigment such as phthalocyanine pigment, perylene and perinone pigments, anthraquinone pigment, quinacridone pigment, dioxane pigment, thioindigo pigment, isoindolinone pigment, and quinophthalone pigment, chelate dye, dye lake, nitro pigment, nitroso pigment, aniline black, and daylight fluorescent pigment may be used. The pigment may be used alone or in combination of two kinds or more.

In addition, as the dye, for example, it is possible to use various dyes used for normal ink jet recording such as direct dye, acid dye, edible dye, basic dye, reactive dyes, disperse dye, vat dye, solubilized vat dye, reactive disperse dye and the like are used. The dye may be used alone or in combination of 2 kinds or more.

In the case of adding the color material, it is preferable that the content thereof be 0.5 mass % or less with regard to the total quantity of the cleaning liquid, and more preferable that it is in the range from 0.001 mass % to 0.5 mass %. By setting the content of the color material to 0.5 mass % or less, it is possible to secure a printing density sufficient for using the cleaning liquid B in itself as the inspection liquid for confirming a discharge of the head for an ink jet printer, and additionally, when it is replaced with a desired ink composition for recording in the step thereafter, it is preferable that defects are less likely to occur due to a mixing of ink colors.

As for the cleaning liquid B in the embodiment, in a viewpoint of washability and the air bubble suppressing action, it is preferable that the surface tension be between 18 mN/m and 40 mN/m, and further preferable that the surface tension be between 20 mN/m to 32 mN/m. Furthermore, for the measurement of the surface tension, for example, an automatic surface tension meter CBVP-Z (trade names, manufactured by Kyowa Interface Science Co., Ltd.) is used, and the measurement is capable to be made by confirming the surface tension when a platinum plate is wetted with the ink composition under an environment of 20° C.

In addition, from a similar viewpoint, it is preferable that the viscosity in the cleaning liquid B at 20° C. be between 2 mPa·s and 8 mPa·s, and further preferable that the viscosity be between 2 mPa·s and 5 mPa·s. Moreover, as for the measurement of the viscosity, for example, viscoelasticity tester MCR-300 (trade name, manufactured by Pysica Co.) is used, and it is possible to measure the viscosity under the environment of 20° C. Moreover, it is preferable that the viscosity in the cleaning liquid at 20° C. is set to be higher than that of the cleaned ink composition at 20° C. As a result, the washability is enhanced further.

For setting the surface tension and the viscosity within the range, it is possible to use a means and the like which adjusts the kind of the penetrating agent or the viscosity modifier, or the addition amount, or the like.

4. Implementation Procedure of Cleaning Method

The implementation procedure will be described in the aforementioned configuration. A cleaning device 200A is configured so as to perform the cleaning method of the invention. That is, it is configured so as to clean the ink supply path 10 by supplying the gas-liquid mixture M to the ink supply path 10 (the first cleaning step), and thereafter, to introduce the cleaning liquid B to the ink supply path 10 (the second cleaning step).

First Cleaning Step

The first cleaning step is the step that cleans by supplying the gas-liquid mixture M of the cleaning liquid A and the gas which is provided with the cleaning action to the ink supply path 10.

First of all, as shown in FIG. 2 and FIG. 3, the dummy cartridge 9D of the cleaning device 200A is attached to the cartridge holder 8 of the ink jet recording device 100 which is an object to be cleaned. When the dummy cartridge 9D is attached to the cartridge holder 8, the connecting member 81 which is provided in the connecting opening of the ink supply path 10 in the cartridge holder 8 is inserted to the opening portion of the supply path 25 provided in the dummy cartridge 9D, and the supply path 25 of the cleaning device 200A and the ink supply path 10 of the ink jet recording device 100 become a state of being connected.

Next, in the cleaning device 200A, the selective valve 22 is switched so as to select the supply path 23 of side 1. According to such switching, the ink supply path 10 of the ink jet recording device 100 becomes a state of being connected to the gas-liquid mixture generating device 20A through the supply path 25 and the supply path 23.

In such a state, the capping member 11 of the ink jet recording device 100 is driven, the nozzle-formed surface of the recording head 6 is sealed, and then, the suction pump 13 is driven. The negative pressure is applied to the ink supply path 10 through the capping member 11 by driving the suction pump 13. According to such negative pressure, the negative pressure is applied to the gas-liquid mixture generating unit 201 of the gas-liquid mixture device 20A. And due to the negative pressure, the cleaning liquid A and air are simultaneously absorbed from a suction opening inside the float member 202, and the gas-liquid mixture M, in which air has been continuously introduced to the cleaning liquid A, is generated. Such gas-liquid mixture M is supplied to the ink supply path 10 through the supply path 23, the selective valve 22, and the supply path 25. The gas-liquid mixture M cleans the inner wall of the ink supply path 10 by exerting a high cleaning action. The waste liquid after cleaning is absorbed through the capping member 11, and is discharged to the waste liquid recovering box 14.

Here, a small quantity of the gas-liquid mixture M which has circulated, and cleaned the ink supply path 10 by the first cleaning step remains in the ink supply path 10. Such gas-liquid mixture M contains a large quantity of air bubbles. There, in a state of the gas-liquid mixture M remaining, when ink is supplied, the gas-liquid mixture M remaining in the ink supply path 10 is mixed into ink, and air bubbles are mixed into ink thereby causing the discharge stability to be inhibited at the time of printing. Thus, the second cleaning step shown below is performed.

Second Cleaning Step

The second cleaning step is a step which cleans the ink supply path by supplying the cleaning liquid B provided with the air bubble suppressing action to the ink supply path 10.

Time set for cleaning the ink supply path 10 has passed, and then driving of the suction pump 13 in the ink jet recording apparatus 100 stops temporarily. And in the cleaning device 200A, the selective valve 22 is switched so as to select the supply path 24 of side 2. By such switching, the ink supply path 10 in the ink jet recording apparatus 100 becomes a state of being connected to the cleaning liquid tank 21 through the supply path 24 and the supply path 25.

In such a state, the capping member 11 of the ink jet recording apparatus 100 is driven once more, the nozzle-formed surface of the recording head 6 is sealed, and then, the suction pump 13 is driven. By driving the suction pump 13, the negative pressure is applied to the ink supply path 10 through the capping member 11. By such negative pressure, this time, the cleaning liquid B from the cleaning liquid tank 21 is supplied to the ink supply path 10 through the supply path 24, the selective valve 22, and the supply path 25. Since the cleaning liquid B is a cleaning liquid provided with the air bubble suppressing action, at the time of discharging the gas-liquid mixture M remaining in the ink supply path 10, the cleaning liquid B eliminates air bubbles, and performs a function of suppressing the generation of air bubbles. The cleaning liquid B which has eliminated air bubbles by mixing itself with the remaining gas-liquid mixture M is absorbed through the capping member 11, and discharged to the waste liquid recovering box 14.

4. Effects

According to the cleaning method and the cleaning device of embodiment 1, the following effects are exhibited.

(1) According to the above cleaning method, by performing the second cleaning step following the first cleaning step as the cleaning method, it is possible to effectively eliminate air bubbles from the gas-liquid mixture M remaining inside the ink supply path 10. As a result, after having shipped the ink jet recording apparatus 100, when, for the first time, a customer attaches the ink cartridge, refills ink, and prints it, it is possible to suppress the amount of air bubbles mixed to ink to an insignificant level from the beginning, to prevent a bad quality of ink dot omissions resulting from a flight curvature or a discharge failure of ink droplets due to the remaining air bubbles, and to secure the high discharge stability.

(2) According to the cleaning method and the cleaning device, in the first cleaning step, since the gas-liquid mixture M of the cleaning liquid and gas is supplied to the ink supply path 10, a highly concentrated ink filled inside the ink supply path 10 by a printing test and the like is immediately pushed out by gas. As a result, the concentration of ink present in the ink supply path is reduced immediately by the cleaning liquid, and the inside of ink supply path is effectively cleaned by the cleaning liquid A supplied mixed with air.

(3) According to the cleaning method and the cleaning device, since the gas-liquid mixture M of the cleaning liquid and gas is used, it is possible that the time required for a cleaning operation is reduced, and that, therewith, the cleaning operation is more efficiently performed with less cleaning liquid.

(4) According to the cleaning method and the cleaning method, it is possible to enhance a cleaning efficiency by using the gas-liquid mixture M. Therefore, it is possible to reduce as much as possible the quantity of waste liquid discarded to the waste liquid recovering box 14 which is attached to the ink jet recording apparatus 100. Accordingly, it is possible to avoid a disadvantage of lowering the effective recovery capacity of the waste liquid recovering box 14 prior to shipping a product.

Embodiment 2

Embodiment 2 of the invention is relating to a modified example of the gas-liquid mixture generating device which generates the gas-liquid mixture M by a three way tube structure.

Figure 4:
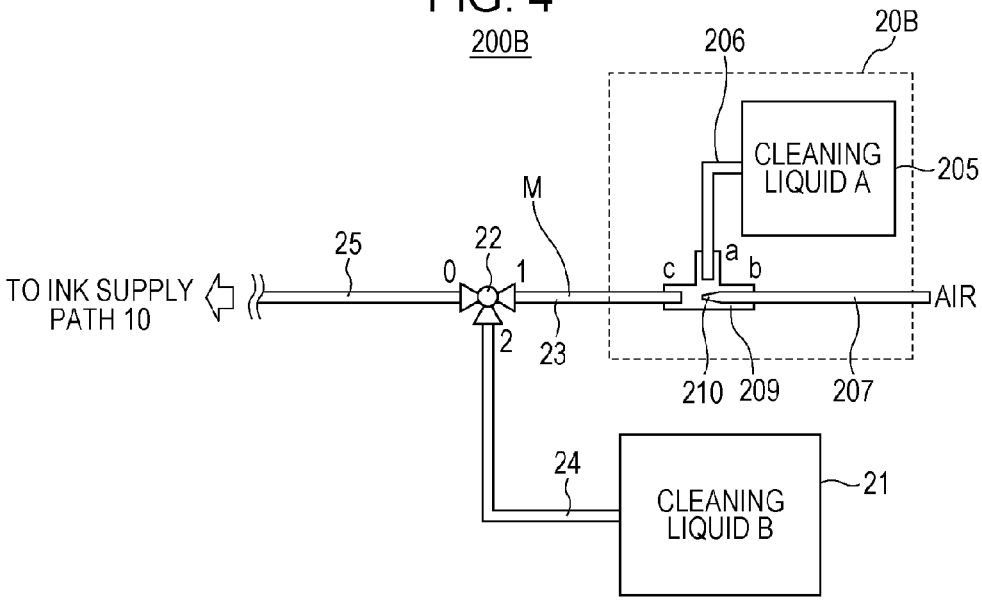
FIG. 4 is a configuration diagram of a cleaning device in a second embodiment of the invention.

FIG. 4 illustrates a configuration diagram of a cleaning device in embodiment 2. A cleaning device 200B in embodiment 2 has a characteristic in a gas-liquid mixture generating device 20B. Since the cleaning liquid tank 21, the selective valve 22, and the dummy cartridge 9D are the same as embodiment 1, a description will be omitted.

As shown in FIG. 4, the gas-liquid mixture generating device 20B in embodiment 2 is provided with a cleaning liquid tank 205 and a three way tube 209. The cleaning liquid tank 205 is filled with the cleaning liquid A therein. The three way tube 209 is formed in a T-shape configured with a tube portion a, a tube portion b, and a tube portion c, and is configured so as to be capable to be connected to the supply path from three directions. A supply path 206 from the cleaning liquid tank 205 is connected to the tube portion a of the three way tube 209. One end of a supply path 207 is connected to the tube portion b of the three way tube 209. In one end of the supply path 207 which is connected to the tube portion b, a nozzle 210 is formed near the center of the three way tube 209. In addition, the other end of the supply path 207 extends to the outside of the gas-liquid mixture generating device 20B, and is opened to be able to absorb air. The supply path 23 which penetrates the selective valve 22 is connected to the tube portion c of the three way tube 209.

The aforementioned configuration describes a corresponding action when performing the cleaning method of the invention.

In the first cleaning step, the dummy cartridge 9D of the cleaning device 200B is attached to the cartridge holder 8 of the ink jet recording apparatus 100. Next, in the cleaning device 200B, the selective valve 22 is switched so as to select the supply path 23 of the side 1. According to such switching, the ink supply path 10 of the ink jet recording apparatus 100 becomes a state of being connected to the gas-liquid mixture generating device 20B through the supply path 25 and the supply path 23.

In such a state, the capping member 11 of the ink jet recording apparatus 100 is driven, the nozzle-formed surface of the recording head 6 is sealed, and the suction pump 13 is driven. As a result, the negative pressure is applied to the three way tube 209 of the gas-liquid mixture generating device 20B. When the inside of the three way tube 209 becomes the negative pressure, the cleaning liquid A of the cleaning liquid tank 205 from the supply path 206, and air from the supply path 207 are absorbed. But since a nozzle 210 of one end of the supply path 207 is protruded in the flow path of the cleaning liquid from the supply path 206 to the supply path 23, when the cleaning liquid A flows inside the three way tube 209, by an ejector effect, air supplied from the supply path 207 is absorbed into the cleaning liquid A, thereby generating air bubbles inside the cleaning liquid. According to such an action, the gas-liquid mixture M mixed with the cleaning liquid A and air is generated in the supply path 23. Such gas-liquid mixture M exerts a higher cleaning action by circulating to the ink supply path 10, and is absorbed through the capping member 11, and is discharged to the waste liquid recovering box 14.

Next, the step proceeds to the second cleaning step, in which driving of the suction pump 13 in the ink jet recording apparatus 100 is temporarily stopped, and then, in the cleaning device 200B, the selective 22 is switched so as to select the supply path 24 of the side 2. By such switching, the ink supply path 10 of the ink jet recording apparatus 100 becomes a state of being connected to the cleaning liquid tank 21 through the supply path 25 and the supply path 24.

In such a state, the capping member 11 of the ink jet recording apparatus 100 is driven once more, the nozzle-formed surface of the recording head 6 is sealed, and, by driving the suction pump 13, the negative pressure is applied to the ink supply path 10 through the capping member 11. By such negative pressure, at this time, the cleaning liquid B from the cleaning liquid tank 21 is supplied to the ink supply path 10 through the supply path 24, the selective valve 22, and the supply path 25. Since the cleaning liquid B is a cleaning liquid provided with an air bubble suppressing action, when discharging the gas-liquid mixture M remaining in the ink supply path 10, the cleaning liquid B eliminates air bubbles, is absorbed through the capping member 11, and is discharged to the waste liquid recovering box 14.

According to embodiment 2, since the gas-liquid mixture generating device 20B generates the gas-liquid mixture M by using the ejector effect, in the first cleaning step, it is possible to provide the gas-liquid mixture M having a high cleaning capability in which air is dispersed to and mixed with the cleaning liquid A as air bubbles. And in the second cleaning step, it is possible to effectively eliminate air from the gas-liquid mixture M remaining in the ink supply path 10.

Embodiment 3

Embodiment 3 of the invention has the same configuration as embodiment 1, and is relating to a modified example which has the one composition of the cleaning liquid in common.

Figure 5:
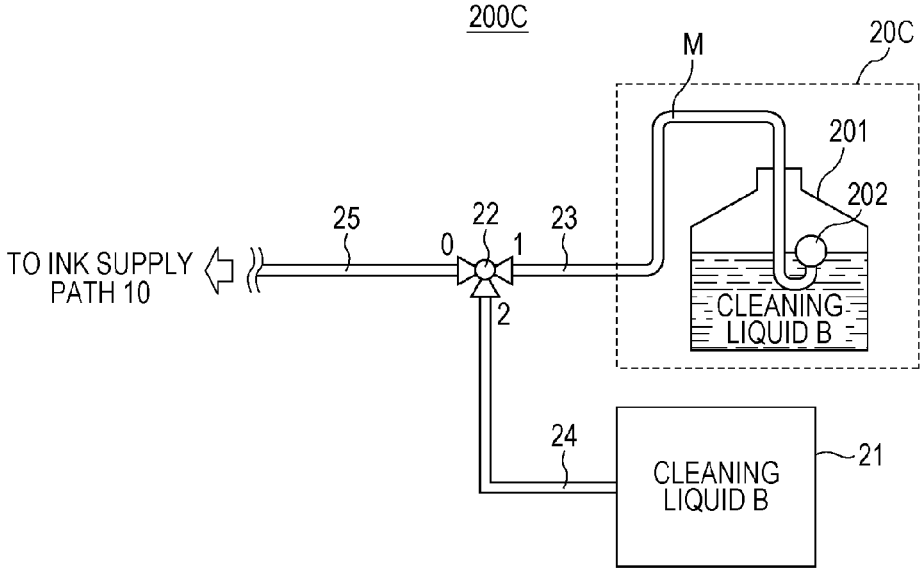
FIG. 5 is a configuration diagram of a cleaning device in a third embodiment of the invention.

FIG. 5 illustrates a configuration diagram of a cleaning device in embodiment 3. A gas-liquid mixture generating device 20C of a cleaning device 200C in embodiment 3 has the same configuration as the gas-liquid mixture generating device 20A of embodiment 1. However, there is one difference between them in that a gas-liquid mixture generating unit 201 as well as the cleaning liquid tank 21 is filled with the cleaning liquid B therein.

As described above, the cleaning liquid B is supplied preferably at the flow velocity of 0.1 mL/(sec·mm$^2$) or more as the gas-liquid mixture M which is mixed with gas, thereby exhibiting a constant cleaning function. Therefore, it is possible to be used instead of the cleaning liquid A.

The cleaning liquid B filled to the gas-liquid mixture generating unit 201, in the first cleaning step, is supplied to the ink supply path 10 at the flow velocity 0.1 mL/(sec·mm$^2$) or more as the gas-liquid mixture M, and thus, it is possible to suitably clean the ink supply path 10. In addition, the cleaning liquid B filled to the cleaning liquid tank 21, in the second cleaning step, is capable to effectively reduce air bubbles which are contained in the gas-liquid mixture M remaining in the ink supply path 10.

Embodiment 4

Embodiment 4 of the invention has the same configuration as embodiment 2, and is relating to a modified example which has the one composition of the cleaning liquid in common.

Figure 6:
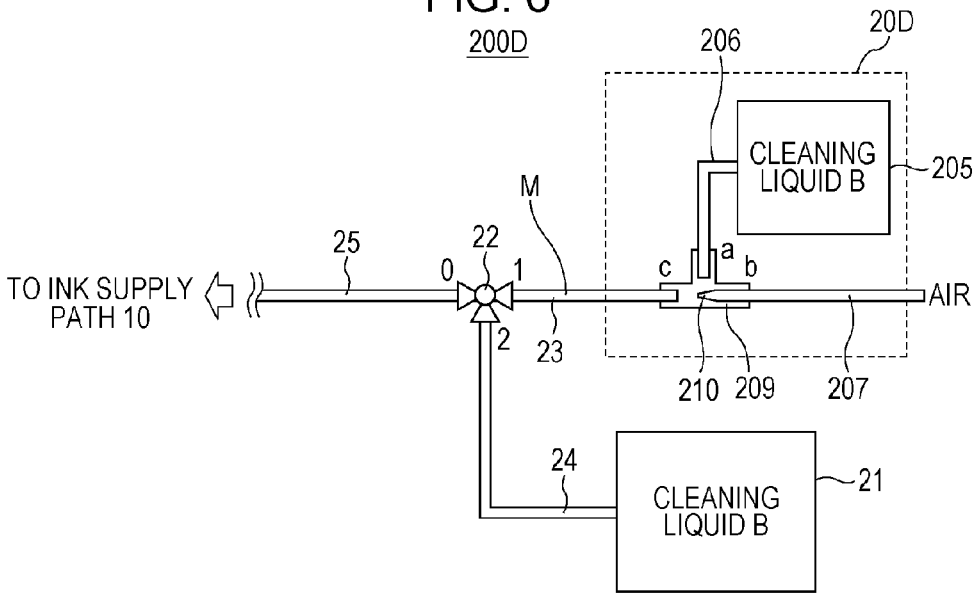
FIG. 6 is a configuration diagram of a cleaning device in a fourth embodiment of the invention.

FIG. 6 illustrates a configuration diagram of the cleaning device in embodiment 4. A cleaning device 200D in embodiment 4 has the same configuration as the gas-liquid mixture generating device 20B in embodiment 2. However, there is one difference between them in that a cleaning liquid tank 205 as well as the cleaning liquid tank 21 is filled with the cleaning liquid B therein.

As described above, the cleaning liquid B is supplied preferably at the flow velocity of 0.1 mL/(sec·mm$^2$) or more as the gas-liquid mixture M which is mixed with gas, thereby exhibiting a constant cleaning function. Therefore, it is possible to be used instead of the cleaning liquid A.

The cleaning liquid B filled to the cleaning liquid tank 205, in the first cleaning step, becomes the gas-liquid mixture M which is mixed with air by the ejector effect of the three way tube 209. Such gas-liquid mixture M is supplied to the ink supply path 10 preferably at the flow velocity 0.1 mL/(sec·mm$^2$) or more, and thus, it is possible to suitably clean the ink supply path 10. In addition, the cleaning liquid B filled to the cleaning liquid tank 21, in the second cleaning step, is capable to effectively reduce air bubbles which are contained in the gas-liquid mixture M remaining in the ink supply path 10.

Embodiment 5

Embodiment 5 of the invention has a similar configuration to embodiment 3, and is relating to a modified example which has the one cleaning liquid tank in common.

Figure 7:
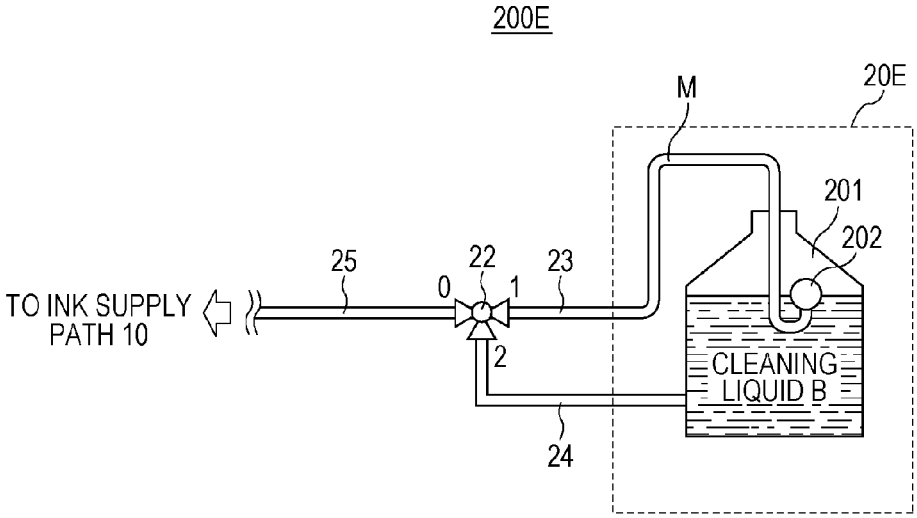
FIG. 7 is a configuration diagram of a cleaning device in a fifth embodiment of the invention.

FIG. 7 illustrates a configuration diagram of a cleaning device in embodiment 5. A cleaning device 200E in embodiment 5 as well as the gas-liquid mixture generating device 20C of embodiment 3 is provided with the gas-liquid mixture generating unit 201 and the float member 202. On the other hand, the cleaning device 200E is different from that of embodiment 3 in that the device supplies the cleaning liquid B used in the second cleaning step from the cleaning liquid tank 201. That is, the supply path 24 selected in the second cleaning step is directly connected to the gas-liquid mixture generating unit 201.

As described above, the cleaning liquid B is supplied preferably at the flow velocity of 0.1 mL/(sec·mm$^2$) or more as the gas-liquid mixture M which is mixed with gas, thereby exhibiting a constant cleaning function. Therefore, it is possible to be used instead of the cleaning liquid A.

In the first cleaning step, the gas-liquid mixture M generated by mixing the cleaning liquid B with air in the gas-liquid mixture generating unit 201 is supplied to the ink supply path 10 preferably at the flow velocity 0.1 mL/(sec·mm$^2$) or more through the supply path 23, the selective valve 22, and the supply path 25, and thus, it is possible to suitably clean the ink supply path 10.

In addition, the cleaning liquid B filled to the gas-liquid mixture generating unit 201, in the second cleaning step, is supplied to the ink supply path 10 through the supply path 24, the selective valve 22, the supply path 25 and thus, it is possible to effectively reduce air bubbles which are contained in the gas-liquid mixture M remaining in the ink supply path 10.

Embodiment 6

Embodiment 6 of the invention has a similar configuration to embodiment 4, and is relating to a modified example which has the one cleaning liquid tank in common.

Figure 8:
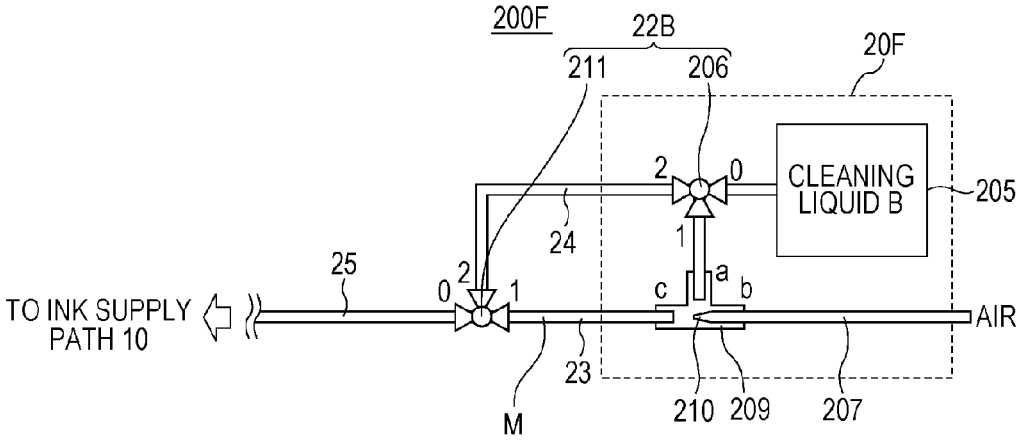
FIG. 8 is a configuration diagram of a cleaning device in a sixth embodiment of the invention.

FIG. 8 illustrates a configuration diagram of a cleaning device in embodiment 6. A cleaning device 200F in embodiment 6 as well as the gas-liquid mixture generating device 20D of embodiment 4 has a gas-liquid mixture generating device 20F which is provided with the cleaning liquid tank 205, the three way tube 209, and the supply tube 207. Further, the cleaning device 200F is different from that of embodiment 4 in that there is provided a selective unit 22B with two of the selective valve 206 and the selective valve 211. The selective valve 206 is configured such that the supply path from the cleaning liquid tank 205 is connected at to side 0, the supply path which communicates with the three way tube 209 is connected to a side 1, and the supply path 24 is connected to a side 2. The selective valve 211 is such that the supply path 25 is connected to a side 0, the supply path 23 is connected to a side 1, and the supply path 24 is connected to a side 2.

As described above, the cleaning liquid B is supplied preferably at the flow velocity of 0.1 mL/(sec·mm$^2$) or more as the gas-liquid mixture M which is mixed with gas, thereby exhibiting a constant cleaning function. Therefore, it is possible to be used instead of the cleaning liquid A.

In the first cleaning step, when the selective valve 206 selects the side 1, the cleaning liquid B from the cleaning liquid tank 205 is supplied to the tube portion a of the three way tube 209 through the selective valve 206. In addition, when a selective valve 211 selects the side 1, the negative pressure which has been exerted to the supply path 25 through the ink supply path 10 from the suction pump 13 is exerted to the tube portion c of the three way tube 209. For such a reason, by the ejector effect described in embodiment 2, the gas-liquid mixture M is generated in the three way tube 209. Such gas-liquid mixture M is supplied to the supply path 10 preferably at the flow velocity of 0.1 mL/(sec·mm$^2$) or more through the supply path 23, a selective valve 211, and the supply path 25. Thus, it is possible to suitably clean the ink supply path 10.

In addition, in the second cleaning step, when the selective valve 206 selects the side 2, the cleaning liquid tank 205 is connected to the supply path 24 through the selective valve 206. In addition, when the selective valve 211 selects the side 2, the negative pressure is applied to the supply path 24 through the ink supply path 10 from the suction pump 13. For such a reason, the cleaning liquid B of a supply tank 205 is supplied to the supply path 10 preferably at the flow velocity of 0.1 mL/(sec·mm$^2$) or more through the selective valve 206, the selective valve 211, and the supply path 25. Thus, it is possible to effectively reduce air bubbles contained in the gas-liquid mixture M remaining in the ink supply path 10.

Moreover, embodiment 6 is described with regard to a mechanism using two selective units, but it is not necessary to impose any limitation on this case. Eventually, in the flow path where the cleaning liquid B circulates, it is desirable that there is provided a selective unit to switch the mixing of gas depending on a selection.

Example 1

Hereinafter, embodiment of the invention is further particularly described by an example. However, the embodiment is not limited to such example.

In the example and a comparative example, materials used for adjusting the cleaning liquid A and the cleaning liquid B are as follows.

Penetrating Agent

BYK-348 (trade name, manufactured by BYK, silicone-based surfactant, Polyether denaturation polydimethylsiloxane, abbreviated as "BYK348" hereinafter)

Olfine PD-002W (manufactured by Nissin Chemical Industry Co., Ltd., Acetylene glycol-based surfactant, abbreviated as "PD-002W" hereinafter)

Emulgen-707 (trade name, manufactured by Kao Corporation, polyoxyethylene alkyl ether)

Diethylene glycol monobutyl ether (abbreviated as "BDG" hereinafter)

1,2-hexanediol (abbreviated as "12HD" hereinafter) Viscosity Modifier

Glycerin (abbreviated as "Gly" hereinafter)

Propylene glycol (abbreviated as "PG" hereinafter) Antifoaming Agent

Safinoru DF-110D (manufactured by Nissin Chemical Industry Co., Ltd., acetylene glycol-based surfactant, abbreviated "DF110D" hereinafter)

Encapsulation Remover 2-pyrrolidone (abbreviated "2P" hereinafter)

Balance

Water

Preparation of Cleaning Liquid A and Cleaning Liquid B

In order to obtain a composition (unit: mass %) according to Table 1 below, cleaning liquids A1 to A4 (the cleaning liquid A) and cleaning liquid B1 to B4 (the cleaning liquid B) are prepared by adding each material and agitating these with a high speed water cooled agitator.

Moreover, the HLB value in Table 1 is a measurement based on Griffin's law described above. In addition, the viscosity in Table 1 is a measurement under the environment of 20° C.

TABLE 1

| | | HLB | Cleaning liquid A1 | Cleaning liquid A2 | Cleaning liquid A3 | Cleaning liquid A4 | Cleaning liquid B1 | Cleaning liquid B2 | Cleaning liquid B3 | Cleaning liquid B4 |
|---|---|---|---|---|---|---|---|---|---|---|
| Penetrating agent | BYK348 | 10 or more | 1 | | | 1 | 1 | | 1 | |
| | PD002W | 9 to 10 | | 1 | | | | 1 | | 1 |
| | EMULGEN707 | 12.1 | | | 1 | | | | | |
| | BDG | — | | 5 | | | | 5 | | |
| | 12HD | — | 5 | 5 | | | 5 | 5 | 5 | 4 |
| Antifoaming agent | DF-110D | 3 | | | | | 1 | 1 | 2 | 1 |
| Viscosity modifier | Gly | — | | 5 | | 15 | 24 | | | |
| | PG | | | | | | | 13 | 15 | |
| Dissolution assistant | 2P | — | | | | | | | 5 | |
| Balance | water | — | 94 | 85 | 99 | 84 | 69 | 76 | 73 | 87 |
| Total | | — | 100 | 101 | 100 | 100 | 100 | 101 | 101 | 93 |
| Viscosity [mPa · s] | | | 2.1 | 4.1 | 1.1 | 4.1 | 7 | 5 | 4.6 | 2 |

Examples 1 to 9 and Comparative Example 1

In a combination shown in Table 2 below, by applying one of the cleaning liquids A1 to A4, and the cleaning liquids B1 to B4 in the first cleaning step and the second cleaning step, examples 1 to 9 and comparative example 1 have been made.

TABLE 2

| | First cleaning step | Second cleaning step | Flow velocity of cleaning liquid A, B | Dissolved N2 content | Washability | Discharge stability | Embodiment |
|---|---|---|---|---|---|---|---|
| Comparative Example 1 | Cleaning liquid A1 | — | 0.5 ml/sec | — | A | C | N/A |
| Example 1 | Cleaning liquid A1 | Cleaning liquid B1 | 0.5 ml/sec | 12 ppm | A | B | 1 |
| Example 2 | Cleaning liquid A1 | Cleaning liquid B1 | 0.5 ml/sec | 2 ppm | A | A | 1 |
| Example 3 | Cleaning liquid A2 | Cleaning liquid B2 | 0.5 ml/sec | 3 ppm | A | A | 1 |
| Example 4 | Cleaning liquid A3 | Cleaning liquid B1 | 0.5 ml/sec | 2 ppm | A | A | 1 |
| Example 5 | Cleaning liquid B2 | Cleaning liquid B2 | 0.5 ml/sec | 6 ppm | A | A | 6 |
| Example 6 | Cleaning liquid B3 | Cleaning liquid B3 | 0.5 ml/sec | 6 ppm | A | A | 6 |
| Example 7 | Cleaning liquid A1 | Cleaning liquid B1 | 1.0 ml/sec | 2 ppm | A | A | 1 |
| Example 8 | Cleaning liquid A1 | Cleaning liquid B1 | 0.2 ml/sec | 2 ppm | B | A | 1 |
| Example 9 | Cleaning liquid A4 | Cleaning liquid B1 | 0.2 ml/sec | 2 ppm | A | A | 1 |
| Example 10 | Cleaning liquid A1 | Cleaning liquid B4 | 0.5 ml/sec | 2 ppm | A | A | 1 |
| Example 11 | Cleaning liquid A1 | Cleaning liquid B1 | 0.05 ml/sec | 2 ppm | C | A | 1 |

Evaluation Items

For the cleaning liquid prepared according to each of examples and each of the comparative examples, an ink jet printer of product no. PX-G930 (manufactured by Seiko Epson Corporation) was selected as a recording device to be evaluated, the cleaning device of embodiment 2 or 6 was attached, the dissolved nitrogen content, the washability, and the discharge stability at the time of refilling ink after a cleaning in the cleaning liquid B have been determined, which eventually, have been listed in Table 2 based on the evaluation standard below.

1. Dissolved Nitrogen Content

The dissolved nitrogen content in the cleaning liquid used in the second cleaning step has been measured with a gas chromatography.

2. Washability

First, the printer has been left undone for a month after having filled white ink to the printer. And then, the first cleaning step and the second cleaning step have been performed by using the cleaning liquid listed in Table 2. Thereafter, the degree of cleaning of the ink supply path has been determined by visual observation. The evaluation standard with regard to the washability is as follows.

In addition, white ink composition used for cleaning is formed by setting titanium dioxide pigment to 8.0 mass %, a silica to 0.8 mass % (Snowtex XL), styrene-acrylic acid copolymer (molecular weight=7000) (dispersant) to 4.0 mass %, propylene glycol to 10.0 mass %, 1,2-hexanediol to 3.0 mass %, and 2-pyrrolidone to 2.0 mass %, and the residue to pure water.

A: Showed a good washability as white ink did not remain substantially in the flow path. Eventually, the cleaning liquid also was substantially transparent after passing through the flow path.

B: Showed a good washability as white ink did not remain substantially in the flow path. Eventually, the cleaning liquid had become a little white after passing through the flow path. This case does not correspond to the range in problem.

C: White ink remains a little in the flow path. Eventually, the cleaning liquid had become a little white after passing through the flow path.

D: Showed an insufficient washability as white ink remains mostly in the flow path. Eventually, the cleaning liquid had also become white and cloudy after passing through the flow path.

3. Discharge Stability

The first cleaning step and the second cleaning step were performed by using the cleaning liquid according to examples and the comparative examples. And then, white ink was refilled to the printer, and the dot omissions have been observed when continuously printing 50 sheets of image pattern of A4 size on transparent films of the same size (OHP film 27077 manufactured by A-One Co., Ltd.). Eventually, the discharge stability has been evaluated.

A: Dot omissions did not occur during printing, and a 50-sheet printing has been completed without a head cleaning operation.

B: Dot omissions occurred during printing, but dot omissions have been dealt with by performing the head cleaning operation 2 to 5 times, and 50-sheet printing has been completed.

C: Dot omissions occurred during printing, and the head cleaning operation was performed 10 times or more. Notwithstanding the operation, dot omissions have not been dealt with, eventually, 50-sheet printing has not been completed.

4. Comprehensive Evaluation

According to the above result, it has been known that the washability depends on the flow velocity of the cleaning liquid, and shows a good cleaning power in 0.2 mL/(sec·mm$^2$), and a high cleaning power when becoming 0.5 mL/(sec·mm$^2$) or more.

As for the discharge stability, it has been known that the discharge stability has been considerably improved after refilling ink by performing the second cleaning step by using the cleaning liquid B containing the surfactant of the HLB value 6 or less. In addition, it has been known that the cleaning liquid B used in the second cleaning step shows more suitable discharge stability after refilling ink when the dissolved nitrogen content thereof is 10 ppm or less.

What is claimed is:

1. A cleaning method of an ink supply path in a recording apparatus in which ink is supplied from an ink cartridge, the method comprising:

a first cleaning step of the ink supply path by supplying a gas-liquid mixture of a cleaning liquid A provided with an ink cleaning action and gas to the ink supply path; and a second cleaning step of the ink supply path by supplying a cleaning liquid B provided with an air bubble suppressing action after the first cleaning step to the ink supply path to remove air bubbles of the gas-liquid mixture in the ink supply path, wherein the cleaning liquid B includes a surfactant having an HLB value of 6 or less as an antifoaminq agent; and the cleaning liquid B is controlled to have a dissolved nitrogen content of 10 ppm or less.

2. The cleaning method according to claim 1, wherein the cleaning liquid B is used as the cleaning liquid A.

3. A cleaning liquid which is the cleaning liquid B in the cleaning method according to claim 2.

4. The cleaning method according to claim 1, wherein the cleaning liquid B is controlled to have a viscosity 2 mPa·s to 8 mPa·s in 20° C.

5. A cleaning liquid which is the cleaning liquid B in the cleaning method according to claim 4.

6. The cleaning method according to claim 1, wherein the cleaning liquid B is introduced at 0.1 mL/(sec·mm$^2$) or more in the ink supply path.

7. A cleaning liquid which is the cleaning liquid B in the cleaning method according to claim 6.

8. The cleaning method according to claim 1, wherein in the first cleaning, the gas-liquid mixture is introduced by a selective unit to the ink supply path.

9. A cleaning liquid which is the cleaning liquid B in the cleaning method according to claim 8.

10. A cleaning liquid which is the cleaning liquid B in the cleaning method according to claim 1.

11. A cleaning device of an ink supply path for a recording apparatus in which ink is supplied from an ink cartridge, the device comprising:

a gas-liquid mixture generating unit which generates a gas-liquid mixture by mixing a cleaning liquid A which is provided with an ink cleaning action and gas; and a selective unit which selects one of the gas-liquid mixture and a cleaning liquid B provided with an air bubble suppressing action, and introduces the selected cleaning liquid to the ink supply path, wherein the selective unit is configured to introduce the cleaning liquid B to the ink supply path after having cleaned the ink supply path by supplying the gas-liquid mixture to the ink supply path to remove air bubbles of the gas-liquid mixture in the ink supply path, wherein the cleaning liquid B includes a surfactant having an HLB value of 6 or less as an antifoaming agent; and the cleaning liquid B is controlled to have a dissolved nitrogen content of 10 ppm or less.

12. The cleaning device according to claim 11, wherein the gas-liquid mixture generating unit mixes the gas and the liquid at a location upstream from the selective unit.

* * * * *